United States Patent [19]

Sanchez et al.

[11] Patent Number: 4,489,796

[45] Date of Patent: Dec. 25, 1984

[54] INSERT FOR A MINE TOOL ROOF BIT AND A METHOD OF DRILLING THEREWITH

[75] Inventors: Jaime Sanchez, Newton; Vinod K. Sarin, Lexington, both of Mass.

[73] Assignee: GTE Laboratories Incorporated, Waltham, Mass.

[21] Appl. No.: 497,960

[22] Filed: May 25, 1983

[51] Int. Cl.[3] ..... E21B 17/00

[52] U.S. Cl. ..... 175/410

[58] Field of Search ..... 175/410, 409, 415–418

[56] References Cited

U.S. PATENT DOCUMENTS

| | | | |
|---|---|---|---|
| 2,598,459 | 5/1952 | Steffes | 175/410 |
| 2,756,967 | 3/1952 | Meutsch | 255/63 |
| 2,902,260 | 9/1959 | Tilden | 175/410 |
| 3,034,589 | 5/1962 | Hagstrom | 175/410 |
| 3,049,033 | 5/1962 | Benjamin et al. | 77/68 |
| 3,163,246 | 12/1964 | Vagins et al. | 175/410 |
| 3,198,270 | 8/1965 | Horvath | 175/410 |
| 3,372,763 | 3/1968 | Fischer | 175/401 |
| 3,434,554 | 3/1969 | Bower | 175/410 |
| 3,595,327 | 7/1971 | Self | 175/410 |
| 4,026,372 | 5/1977 | Hampson | 175/419 |
| 4,099,585 | 7/1978 | Emmerich | 175/410 |
| 4,143,723 | 3/1979 | Schmotzer | 175/410 |
| 4,165,790 | 8/1979 | Emmerich | 175/410 |
| 4,189,013 | 2/1980 | Adams | 175/410 |
| 4,342,368 | 8/1982 | Denman | 175/410 |

*Primary Examiner*—William F. Pate, III

*Attorney, Agent, or Firm*—Ivan L. Ericson

[57] ABSTRACT

A mine tool roof bit insert geometry having a radius of curvature of 1/16 inch at the corners improves the maximum wear and penetration rate when drilling into sandstone and a method therewith is described.

8 Claims, 3 Drawing Figures

INSERT FOR A MINE TOOL ROOF BIT AND A METHOD OF DRILLING THEREWITH

CROSS-REFERENCE TO RELATED APPLICATIONS

Co-pending patent applications, Ser. No. (Attorney's docket number 83-3-012) filed concurrently herewith, entitled "A Mine Tool Roof Bit Insert And A Method Of Drilling Therewith" by Sarin and Sanchez; and Ser. No. (Attorney's docket number 83-3-040) filed concurrently herewith, entitled "A Roof Bit Insert For A Mine Tool And A Method Of Drilling Therewith" by Sarin all assigned to GTE Laboratories Incorporated, assignee of the present application, all concern related subject matter of this application.

FIELD OF THE INVENTION

This invention relates to mine tool inserts. More particularly, it is concerned with mine tool roof bit inserts.

BACKGROUND OF THE INVENTION

The roof of coal mine shafts require support during a mining operation. This support is provided by roof bolts which are anchored into the rock strata found above the coal seam. In order to attach the roof bolts to the roof of a coal mine, many holes must be drilled into the rock strata and spaced close enough to provide a strong safe roof in the mine.

The speed in which holes can be drilled and the costs of the tools are important factors in a mining operation; therefore, any improvement in either of these factors is desired.

SUMMARY OF THE INVENTION

In accordance with one aspect of the present invention, a new and improved mine tool roof bit insert is provided. The new and improved mine tool roof bit insert comprises a flat elongated member having a bottom surface, a first side surface, a second side surface, a first end surface, a second end surface, a first top surface, a second top surface, and a central axis.

The first side surface is substantially parallel with the second side surface. The first side surface and second side surface are substantially perpendicular to the bottom surface.

An intersection of the first side surface and the first top surface forms a first top cutting edge. An intersection of the second side surface and the first top surface forms a first top trailing edge. The first top cutting edge has a first top relief angle between the first top cutting edge and the first top trailing edge.

An intersection of the second side surface and the second top surface forms a second top cutting edge. An intersection of the first side surface and the second top surface forms a second top trailing edge. The second top cutting edge has a second top relief angle between the second top cutting edge and the second top trailing edge.

An intersection of the first side surface and the first end surface forms a first end cutting edge. An intersection of the second side surface and the first end surface forms a first end trailing edge. The first end cutting edge has a first clearance angle between the first end cutting edge and the first end trailing edge.

An intersection of the second side surface and the second end surface forms a second end cutting edge. An intersection of the first side surface and the second end surface forms a second end trailing edge.

An intersection of the first top surface and the second top surface forms a top edge.

An intersection of the first top cutting edge and the second top trailing edge forms a first top included angle.

An intersection of the second top cutting edge and the first top trailing edge forms a second top included angle.

The first end surface and the second end surface angle downward toward the bottom surface forming a taper. The taper has a first included taper angle between the first end surface and the central axis, and a second included taper angle between the second end surface and the central axis.

An intersection of the first top surface and the first end surface forms a first rounded corner having a first radius of curvature. The first rounded corner has a point located thereon. The point is located at a maximum distance from the central axis along a line perpendicular to the central axis.

An intersection of the second top surface and the second end surface forms a second rounded corner having a second radius of curvature. The second rounded corner has a point located thereon. The point is located at a second maximum distance from the central axis along a line perpendicular to the central axis. The maximum first distance added to the maximum second distance defines a maximum diameter of the insert.

The first radius of curvature and the second radius of curvature being from about $D/(32\times1.375)$inches to about $3D/(32\times1.375)$ inches.

The first side surface, the first end surface, and the first top surface and the corresponding second side surface, second end surface and second top surface are symmetrical about the central axis.

In accordance with another aspect of the present invention, a new and improved method of drilling a hole in a mine roof is provided. The new and improved method comprises positioning a mine tool having a mine tool roof bit insert according to the present invention, rotating the mine tool roof bit insert from about 200 to about 1000 rpm, applying a thrust to the mine tool roof bit insert from about 1000 to about 8000 lbs. and drilling a hole in a mine roof.

For a better understanding of the present invention, together with other and further objects, advantages and capabilities thereof, reference is made to the following disclosure and appended claims in connection with the above-described drawing.

DETAILED DESCRIPTION OF THE PREFERRED EMBODIMENTS

Figure 1:
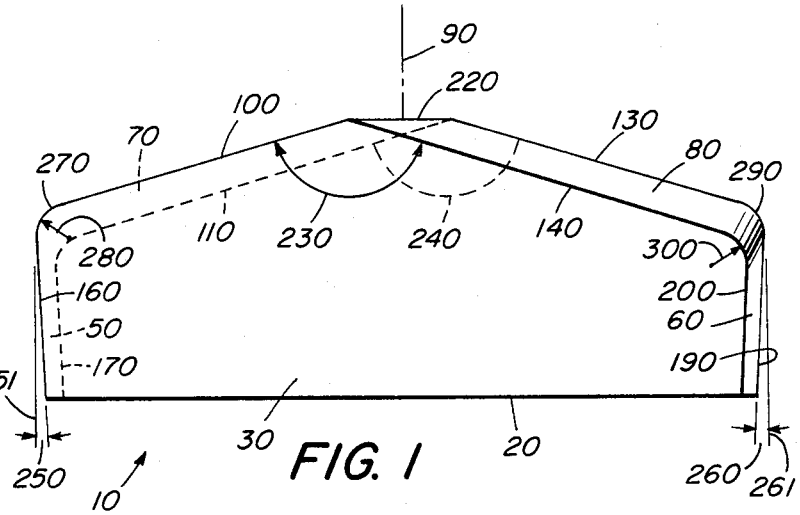
FIG. 1 is a front view of a mine tool roof bit insert according to the present invention.

Referring now to the drawing with greater particularity, there is shown in FIG. 1 a side view of a mine tool roof bit insert 10 made from a hard wear-resistant material such as cemented carbide. The mine tool roof bit insert 10 comprises a flat elongated member having a bottom surface 20, a first side surface 30, a second side surface 40, shown in FIGS. 2 and 3, a first end surface 50, a second end surface 60, a first top surface 70, a second top surface 80, and a central axis 90.

Figure 2:
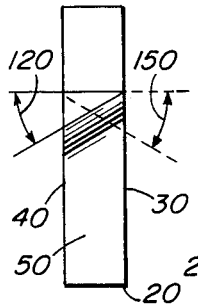
FIG. 2 is a left side view of the present invention shown in FIG. 1.
Figure 3:
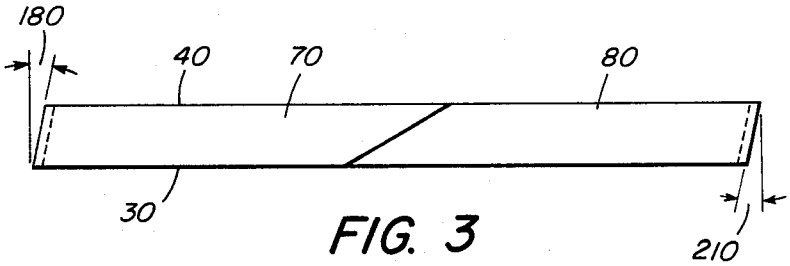
FIG. 3 is a top view of the present invention shown in FIG. 1.

The first side surface 30 is substantially parallel with the second side surface 40, shown in FIGS. 2 and 3. The distance, between the first side surface 30 and second side surface 40 is about 3/16 inches. The first side surface 30 and second side surface 40 are substantially perpendicular to the bottom surface 20.

An intersection of the first side surface 30 and the first top surface 70 forms a first top cutting edge 100. An intersection of the second side surface 40 shown in FIGS. 2 and 3 and the first top surface 70 forms a first top trailing edge 110.

The first top cutting edge 100 has a first top relief angle 120 shown in FIG. 2, such as 18° to 20°, between the first top cutting edge 100 and the first top trailing edge.

An intersection of the second side surface 40 and the second top surface 80 forms a second top cutting edge 130. An intersection of the first side surface 30 and the second top surface 80 forms a second top trailing edge 140. The second top cutting edge 130 has a second top relief angle 150 shown in FIG. 2, such as 18° to 20°, between the second top cutting edge 130 and the second top trailing edge 140.

An intersection of the first side surface 30 and the first end surface 50 forms a first end cutting edge 160. An intersection of the second side surface 40 shown in FIGS. 2 and 3 and the first end surface 50 forms a first end trailing edge 170. The first end cutting edge 160 has a first clearance angle 180 shown in FIG. 3, such as 3°, between the first end cutting edge 160 and the first end trailing edge 170.

An intersection of the second side surface 40 shown in FIGS. 2 and 3 and the second end surface 60 forms a second end cutting edge 190. An intersection of the first side surface 30 and the second end surface 60 forms a second end trailing edge 200. The second end cutting edge 190 has a second clearance angle 210 shown in FIG. 3, such as 3°, between the second end cutting edge 190 and the second end trailing edge 200.

An intersection of the first top surface 70 and the second top surface 80 forms a top edge 220.

An intersection of the first top cutting edge 100 and the second top trailing edge 140 forms a first top included angle 230, such as 140°.

An intersection of the second top cutting edge 130 and the first top trailing edge 110 forms a second top included angle 240, such as 140°.

The first end surface 50 and the second end surface 60 angle downward toward the bottom surface 20 forming a taper. The taper has a first included taper angle 250 between the first end surface 50 and a line 251 parallel to the central axis 90, and a second included taper angle 260 between the second end surface 60 and a line 261 parallel to the central axis 90.

The taper is equal to the gauge diameter (maximum diameter of the insert) minus the taper diameter (the maximum length of the bottom surface of the insert) which is typically expressed as:

gauge diameter−[0.004″±0.004″]=taper diameter.

An intersection of the first top surface 70 and the first end surface 50 forms a first rounded corner 270 having a first radius of curvature 280. The first rounded corner 270 has a point located thereon. The point is located a a maximum first distance from the central axis along a line perpendicular to the central axis.

An intersection of the second top surface 80 and the second end surface 60 forms a second rounded corner 290 having a second radius of curvature 300. The second rounded corner 290 has a point located thereon. The point is located at a maximum second distance from the central axis along a line perpendicular to the central axis 90. The maximum first distance added to the maximum second distance defines a maximum diameter of the insert 10. The maximum diameter or gauge diameter is the diameter of a circle circumscribed by the outermost cutting edges 160 and 190 of the insert 10 when the insert 10 rotates about its central axis 90.

The first radius of curvature 280 and the second radius of curvature 300 are from about 1/32 inches to about 3/32 inch, preferably about 1/16 inch for an insert having a diameter of one and three eighth inch.

For inserts having diameters other than one and three eighth inch, the radius of curvature 280 or 300 is from about D/(32×1.375)inches to about 3D/(32×1.375) inches preferably about D/(16×1.375) where D is the maximum diameter also known as the gauge diameter of the insert 10, such as 1 1/32″, 1 1/16″, 1⅛″, 1⅜″, 1½″, 1⅝″, 1¾″.

The first side surface 30, the first end surface 50, and the first top surface 70 and the corresponding second side surface 40, second end surface 60 and second top surface 80 are symmetrical about the central axis 90.

TABLE I

Drilling Tests of Roof Bit Inserts In Sandstone

| Test | Drilling Conditions | Corner Radius (in) | Penetration Rate, Ave. (in/min) | Max Wear (in) |
|---|---|---|---|---|
| 1 | 4000 lb 400 rpm | Control no radius | 51 | 0.099 |
| 2 | 4000 lb 400 rpm | 1/16″ | 47.2 | 0.090 |
| 3 | 4000 lb 400 rpm | ⅛″ | 40.0 | 0.095 |
| 4 | 5000 lb 400 rpm | Control no radius | 58.0 | 0.112 |
| 5 | 5000 lb 400 rpm | 1/16″ | 53.0 | 0.092 |
| 6 | 5000 lb 400 rpm | ⅛″ | 49.0 | 0.124 |
| 7 | 3000 lb 300 rpm | Control no radius | 27.6 | 0.151 |
| 8 | 3000 lb 300 rpm | 1/16″ | 30.2 | 0.096 |
| 9 | 3000 lb 600 rpm | Control no radius | 40.3 | 0.184 |
| 10 | 3000 lb 600 rpm | 1/16″ | 41.1 | 0.154 |

TABLE II

Drilling Tests of Roof Bit Inserts In Concrete 2:1

| Test | Drilling Conditions | Corner Radius (in) | Penetration Rate, Ave. (in/min) | Max Wear (in) |
|---|---|---|---|---|
| 1 | 4000 lb 400 rpm | Control no radius | 56.4 | 0.078 |
| 2 | 4000 lb 400 rpm | Control no radius | 62.0 | 0.085 |
| 3 | 4000 lb 400 rpm | 1/32″ | 52.0 | 0.085 |
| 4 | 4000 lb 400 rpm | 3/32″ | 61.9 | 0.042 |

Laboratory drilling tests were performed on sandstone and concrete 2:1 using 1 ⅜″ diameter roof bit inserts as shown in Table I and Table II.

The data from the tests show the maximum wear (in.) of the roof bit insert of the present invention is better than the standard (control) insert.

The drilling conditions can vary from about 200 rpm to about 1000 rpm, preferably from about 200 rpm to about 600 rpm and most preferably from about 300 rpm to about 500 rpm. The thrust load can vary from about 1000 lbs to about 8000 lbs, preferably from about 3000 lbs to about 5000 lbs.

While there has been shown and described what is at present considered the preferred embodiment of the invention, it will be obvious to those skilled in the art that various changes and modifications may be made therein without departing from the scope of the invention as defined by the appended claims.

What is claimed is:

1. A mine tool roof bit insert of a hard wear-resistant cemented carbide comprising a flat elongated member having a bottom surface, a first side surface, a second side surface, a first end surface, a second end surface, a first top surface, a second top surface, and a central axis; said first side surface being substantially parallel with said second side surface, said first side surface and second side surface being substantially perpendicular to said bottom surface;

an intersection of said first side surface and said first top surface forming a first top cutting edge, an intersection of said second side surface and said first top surface forming a first top trailing edge, said first top cutting edge having a first top relief angle between said first top cutting edge and said first top trailing edge;

an intersection of said second side surface and said second top surface forming a second top cutting edge, an intersection of said first side surface and said second top surface forming a second top trailing edge, said second top cutting edge having a second top relief angle between said second top cutting edge and said second top trailing edge;

an intersection of said first side surface and said first end surface forming a first end cutting edge, an intersection of said second side surface and said first end surface forming a first end trailing edge, said first end cutting edge having a first clearance angle between said first end cutting edge and said first end trailing edge;

an intersection of said second side surface and said second end surface forming a second end cutting edge, an intersection of said first side surface and said second end surface forming a second end trailing edge; said second end cutting edge having a second clearance angle between said second end cutting edge and said second end trailing edge;

an intersection of said first top surface and said second top surface forming a top edge; an intersection of said first top cutting edge and said second top trailing edge forming a first top included angle;

an intersection of said second top cutting edge and said first top trailing edge forming a second top included angle;

said first end surface and said second end surface angling downward toward said bottom surface forming a taper, said taper having a first included taper angle between said first end surface and said central axis and a second included taper angle between said second end surface and said central axis;

an intersection of said first top surface and said first end surface forming a first rounded corner having a first radius of curvature said first rounded corner having a point located thereon, said pont being located at a first maximum distance from said central axis along a line perpendicular to said central axis, an intersection of said second top surface and said second end surface forming a second rounded corner having a second radius of curvature said second rounded corner having a point located thereon, said point being located at a second maximum distance from said central axis along a line perpendicular to said central axis, said first maximum distance added to said second maximum distance defining a maximum diameter of said insert;

said first radius of curvature and said second radius of curvature being from about $D/(32\times1.375)$ inches to about $3D/(32\times1.375)$ inches, wherein D is said maximum diameter of said insert;

said first side surface, said first end surface, and said first top surface, and corresponding said second side surface, said second end surface, and said second top surface being symmetrical about said central axis; said first radius of curvature and said second radius of curvature of said mine tool roof bit insert being sufficient to decrease maximum wear of said mine tool roof bit insert generated by drilling holes in a mine roof utilizing said mine tool roof bit insert.

2. A method of drilling a hole in a mine tool roof to decrease maximum wear of a mine tool roof bit insert comprising positioning a mine tool having a mine tool roof bit insert, said mine tool roof bit insert comprising a flat elongated member having a bottom surface, a first side surface, a second side surface, a first end surface, a second end surface, a first top surface, a second top surface, and a central axis; said first side surface being substantially parallel with said second side surface, said first side surface and second side surface being substantially perpendicular to said bottom surface;

an intersection of said first side surface and said first top surface forming a first top cutting edge, an intersection of said second side surface and said first top surface forming a first top trailing edge, said first top cutting edge having a first top relief angle between said first top cutting edge and said first top trailing edge;

an intersection of said second side surface and said second top surface forming a second top cutting edge, an intersection of said first side surface and said second top surface forming a second top trailing edge, said second top cutting edge having a second top relief angle between said second top cutting edge and said second top trailing edge;

an intersection of said first side surface and said first end surface forming a first end cutting edge, an intersection of said second side surface and said first end surface forming a first end trailing edge, said first end cutting edge having a first clearance angle between said first end cutting edge and said first end trailing edge;

an intersection of said second side surface and said second end surface forming a second end cutting edge, an intersection of said first side surface and said second end surface forming a second end trailing edge, said second end cutting edge having a second clearance angle between said second end cutting edge and said second end trailing edge;

an intersection of said first top surface and said second top surface forming a top edge;

an intersection of said first top cutting edge and said second top trailing edge forming a first top included angle; an intersection of said second top cutting edge and said second top trailing edge forming a first top included angle;

said first end surface and said second end surface angling downward toward said bottom surface forming a taper, said taper having a first included taper angle between said first end surface and said central axis and a second included taper angle between said second end surface and said central axis; an intersection of said first top surface and said first end surface forming a first rounded corner having a first radius of curvature said first rounded corner having a point located thereon, said point being located at a first maximum distance from said central axis along a line perpendicular to said central axis, an intersection of said second top surface and said second end surface forming a second rounded corner having a second radius of curvature said second rounded corner having a point located thereon, said pont being located at a second maximum distance from said central axis along a line perpendicular to said central axis, said first maximum distance added to said second maximum distance defining a maximum diameter of said insert;

said first radius of curvature and said second radius of curvature being from about $D/(32\times1.375)$ inches to about $3D/(32\times1.375)$ inches, wherein D is said maximum diameter of said insert;

said first side surface, said first end surface, and said first top surface, and corresponding said second side surface, said second end surface, and said second top surface being symmetrical about said central axis, said first radius of curvature and said second radius of curvature being sufficient to decrease the maximum wear of said mine tool roof bit insert;

rotating said mine tool roof bit insert from about 200 to about 1000 rpm;

applying a thrust to said mine tool roof bit insert from about 1000 to about 8000 lbs; and drilling a hole in said mine roof.

3. A mine tool roof bit insert according to claim 1 wherein said radius of curvature of said first rounded corner and of said second rounded corner is $D/(16\times1.375)$ inches.

4. A mine tool roof bit insert according to claim 1 wherein said radius of curvature of said first rounded corner and of said second rounded corner is 1/16 of an inch.

5. A mine tool roof bit insert according to claim 1 wherein said maximum diameter is from about one inch to about one and three quarters inches.

6. A method according to claim 2 wherein said rotating is from about 200 to about 600 rpm.

7. A method according to claim 2 wherein said rotating is from about 300 to about 500 rpm.

8. A method according to claim 2 wherein said thrust is from about 1500 to about 5000 lbs.

* * * * *